US006298640B1

(12) United States Patent
Schneider

(10) Patent No.: US 6,298,640 B1
(45) Date of Patent: Oct. 9, 2001

(54) GRAB SADDLE SYSTEM

(76) Inventor: John R. Schneider, 4 Woodside Dr., East, Apalachin, NY (US) 13732

( * ) Notice: Subject to any disclaimer, the term of this patent is extended or adjusted under 35 U.S.C. 154(b) by 0 days.

(21) Appl. No.: 09/375,768

(22) Filed: Aug. 17, 1999

(51) Int. Cl.[7] ..... B68C 1/04
(52) U.S. Cl. ..... 54/44.3; 54/23
(58) Field of Search ..... 54/44.3, 23, 44.7, 54/46.1, 35; 119/856, 863, 907, 771

(56) References Cited

U.S. PATENT DOCUMENTS

| | | | | |
|---|---|---|---|---|
| 105,080 | * | 7/1870 | Horter . | |
| 271,933 | * | 2/1883 | Smith . | |
| 3,768,445 | * | 10/1973 | Sorrels | 119/856 |
| 3,828,521 | * | 8/1974 | Dulaney | 54/23 |
| 4,033,097 | * | 7/1977 | Petit | 54/44.6 |
| 4,187,663 | * | 2/1980 | LaCroix, Jr. | 54/23 |
| 4,414,790 | * | 11/1983 | Mitchell | 54/2 |
| 4,905,458 | * | 3/1990 | Johnston et al. | 54/23 |
| 4,987,654 | * | 1/1991 | Mejias | 24/170 |
| 5,031,387 | * | 7/1991 | Rider | 54/23 |
| 5,226,282 | * | 7/1993 | Meyers | 54/23 |
| 5,423,164 | * | 6/1995 | Schneider | 54/44.1 |
| 5,713,308 | * | 2/1998 | Holt, Jr. | 119/856 |
| 5,852,852 | * | 12/1998 | Rigal | 24/68 R |
| 5,896,831 | * | 4/1999 | Alpert | 119/856 |
| 5,901,531 | * | 5/1999 | Rogers | 54/44.1 |
| 6,058,685 | * | 5/2000 | Wotring | 54/23 |

* cited by examiner

*Primary Examiner*—Charles T. Jordan
*Assistant Examiner*—Yvonne R. Abbott

(57) ABSTRACT

To improve the safety of horseback riding, a fabric saddle with hook fastener strips sewed to its side fenders attaches to the horse using a new design of harness that gives the rider the ability to mechanically make a secondary tightening of that harness around the horse after the standard initial manual girth strap tightening has been done. This secondary tightening has the characteristic of being controlled so as not to harm the horse yet it snugs the saddle up so there is much less likelihood of the saddle slipping off the horse's back. As the rider mounts, the loop fastener strips on the rider's pants legs match with the hook fastener strips on the saddle and hold the rider onto the animal so the rider is not accidentally thrown off the horse. Quick dismount is not inhibited since the hook and loop fastener strips separate readily when the riders kick their legs away from the horse.

19 Claims, 14 Drawing Sheets

VIEW A-A

VIEW B-B

VIEW C-C

ITEM 55a

ITEM 55

GRAB SADDLE SYSTEM

FIELD OF THE INVENTION

The present invention pertains to harnesses and saddles for horses and other beasts of burden.

BACKGROUND OF THE INVENTION

To date, the common means of securing a saddle or other load bearing attachment to a horse or other beast of burden is to utilize straps secured tightly around the animal usually placed just behind the animal's front legs and around the entire chest of the animal. These straps are made of leather or some strong fabric or other material and are secured and tightened using metal buckles or fittings of an appropriate type or some other form of fastening hardware. This requires the rider or some other horse handler to physically manipulate these straps and buckles to get them as tight as that person's strength allows. Many times that strength is not sufficient to the task and the saddle is so loose on the horse that it slides sideways putting the user in severe jeopardy of falling off the horse.

This problem is often exacerbated by the horse inhaling a large amount of air while being saddled to purposely prevent the saddle from being strapped on tight enough to be safe. After holding that air in until the saddle has been tightened, the horse exhales it and the saddle immediately gets much looser on its body. To further confound the problem, modern saddles are mere copies of saddle concepts that have been used for millenniums and are lacking in many aspects of rider comfort and safety. Studies show that between 60 to 85 percent of all injuries due to human contact with horses are due to the rider being ejected from the horse's back accidentally.

Yet another problem is the position on the horse's back which is taken by saddles made to the current, universally popular design. At the point on the horse's back where all saddles of the current design are positioned there is no physical prominence of the horse's anatomy that provides a positive bearing surface to anchor the saddle in a central, upright position. Therefore, many riders are injured and some even killed when the saddle they are riding on spins or rotates around the round midsection of the horse's body where almost all saddles are positioned when in use.

SUMMARY OF THE INVENTION

It is an object of the present invention to produce a harness and saddle assembly capable of being tightened so it holds properly in place on the horse even when tightened by a weak person because of the novel design of a secondary tightening device that is employed after the first tightening adjustment has been accomplished.

It is a further object of the present invention to produce a harness and grab saddle assembly including the art explained in my U.S. Pat. No. 5,423,164 to provide a complete saddle system which will weigh far less than currently designed saddles yet allow the rider to so secure themselves to the horse that they are more safely mounted than any current saddle systems are capable of doing.

It is a further object of this invention to present a complete saddle concept that will replace and obsolete all current saddle designs and their attendant accessories and inherent dangers.

It is a further object of this invention to provide a saddle design that prevents most accidents caused by the rotation of the saddle when mounted on a horse.

It is a further object of this invention to provide a viable saddle design that has minimal weight.

It is a further object of this invention to provide a saddle design which removes any rigid saddle framework from underneath the rider so there is no harmful, rigid frame positioned between the rider and the horse to gouge the horse's back by being driven down into the horse's back by the action of the rider's weight bouncing on top of the saddle.

It is a further object of this invention to provide a design for a saddle device that can help hold a rider in place in the saddle so most accidental ejection accidents are prevented.

DESCRIPTION OF THE PREFERRED EMBODIMENTS

Figure 1:
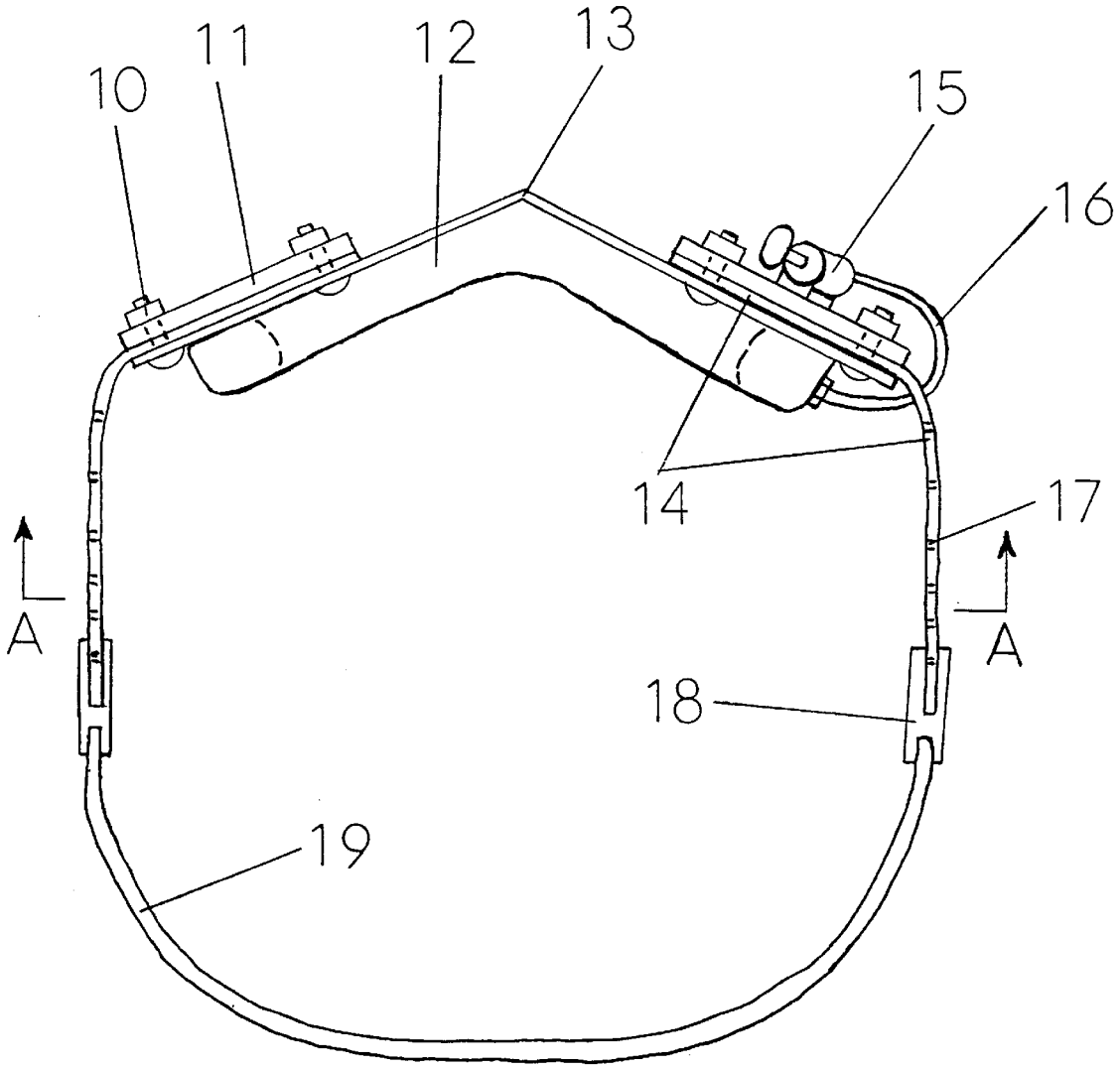
FIG. 1 is an end view of the harness's preferred embodiment.

Referring now to the drawings wherein like reference characters indicate like parts in the several views, there is shown in FIG. 1 an end view from the rear of the harness portion of the system assembly. Item 10 is one of several mounting bolts shown which hold wood slabs 11 onto steel straps 13 and between them is sandwiched the perforated leather straps 14. Item 17 indicates one perforation of many made in item 14. Item 12 is an inflatable air bladder that receives its pressurized air through air tube 16 from hand pump 15. Air tube 16 also houses a manual pressure relief valve which is operated by the user when it is time to remove the Grab Saddle Assembly from the horse. Item 12 may be, for instance, a bicycle tire containing a bicycle tire inner tube which assembly can be attached to the wooden slab 11 by the use of glue or wood screws or some other mechanical mounting method or device. Items 14 which are the perforated leather straps are shown attached to item 19 by the use of buckles 18 which serve to join the two items into a length adjustable assembly. This assembly of straps 14 and 19 provides a strap assembly harness that encircles the chest of the horse as is the current custom for attaching a saddle to a horse or other beast of burden and holding it in place while the animal is being ridden. The tightening of straps 14 and 19 using buckle 18 to secure that tightening provides the initial tightening of the saddle around the horse or other beast of burden. After the initial hand tightening of this harness assembly made up of items 14, 18 and 19 around the horse, the inflation of said air tube 12 accomplishes the invented secondary tightening of the harness. This happens because the pressurized gas expands the dimensions of item 12 on top of the horse after the user or rider has first pulled the girth straps 14 and 19 as tight as possible by hand and buckled or tied them off so they hold that initially adjusted dimension. It can be seen that item 12 can only inflate to its maximum dimension and after that it will not become any larger therefor it can only tighten up around the horse's body by a fixed amount so the horse is in no danger of being squeezed too tightly by the saddle girth 19 and saddle straps 14.

Figure 2:
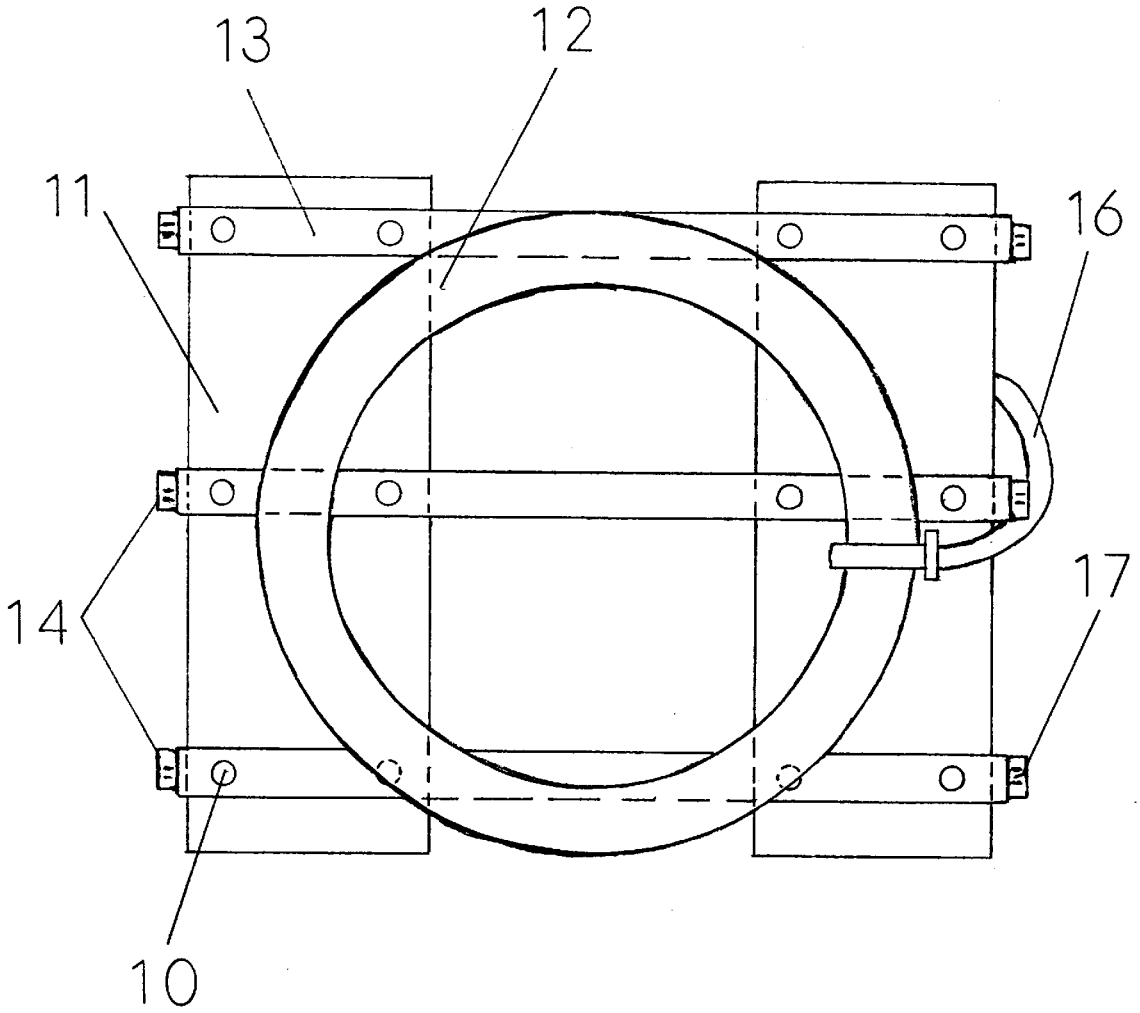
FIG. 2 is a bottom view of the harness shown in FIG. 1.

FIG. 2 is a bottom view of the harness assembly's underside which side contacts the horse's back as described by view A—A which is indicated in FIG. 1. It displays the circular shape of item 12 which is the secondary tightening device employed in this FIGS. 1 and 2 embodiment. As explained later, this is only one of many mechanical methods that can be employed to accomplish the invented secondary tightening of the harness as described in this patent. This circular shape indicates a bicycle tire and tube although this item 12 air chamber could be any shape or a specially designed shape and still function properly given it were a proper size and placed in the proper position. This tire and tube are connected for air pressure to the other end of the air hose emanating from an air pump item 15. This pump can be either manual or power driven or the pressurized gas supply can come from a pre pressurized gas pressure reservoir which has not been shown.

Figure 3:
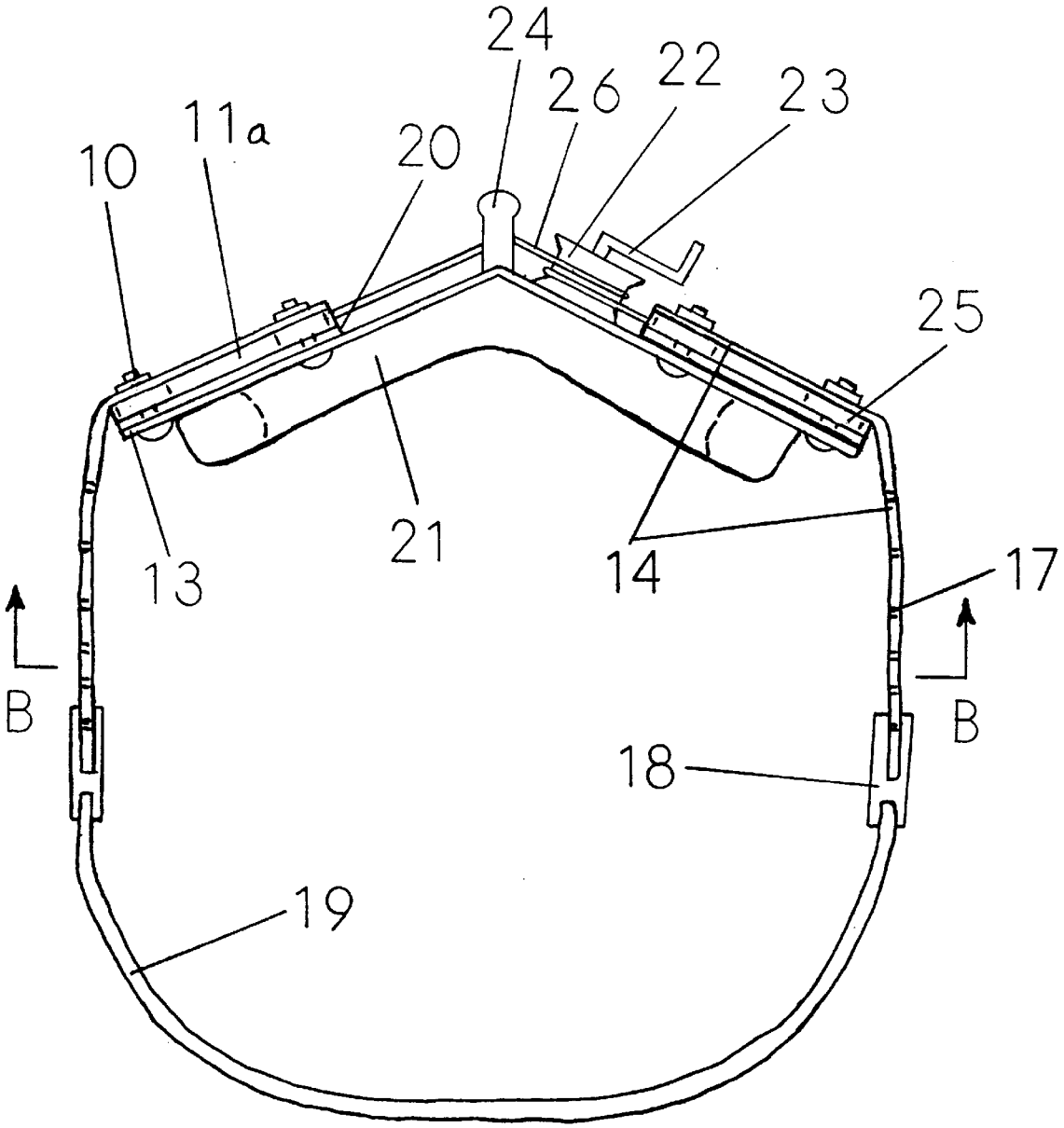
FIG. 3 is an end view of the harness with a winch.

FIG. 3 is a view the same as FIG. 1 but showing another mechanical means of accomplishing the invented secondary tightening of the harness method of securing a load carrying device to a beast of burden. It shows the utilization of a winch 22 and winch handle 23 which allows the user to manually turn the winch to tighten the harness straps items 14 and 19. The lines 26 are wound around the winch 22 as it turns and said lines are attached at their other ends to glide blocks 11*a* on either side of the animal, said glide blocks slide against and are guided by the locator bolts 10 which project through slots 25 in the glide blocks 11*a*. Glide blocks 11*a* also slide upon and are supported by slide plates 20. This back and forth sliding of the glide blocks alternately tightens and loosens the straps 14 which are attached to glide blocks 11*a* and which in turn likewise effects their attached girth strap 19.

Figure 4:
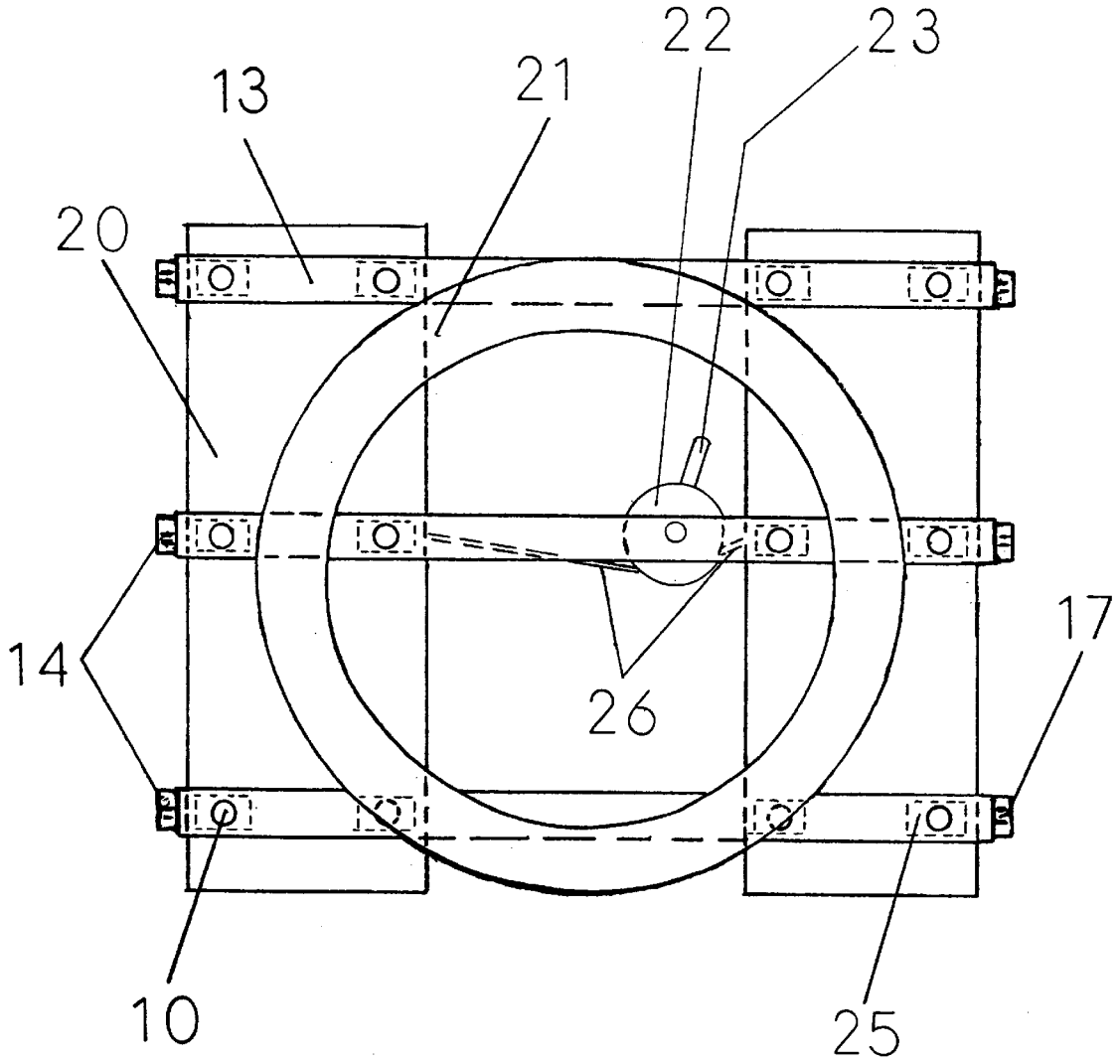
FIG. 4 is a bottom view of the harness shown in FIG. 3.

FIG. 4 is a view B-B which is the same as FIG. 2's view A—A but showing the embodiment for the invented secondary tightening of the harness system as described in FIG. 3. It must be noted that there are many such mechanisms like those described in FIGS. 1 and 3 that are known and can function to effect the invented secondary tightening of the harness herein disclosed and not all of them are shown in these figures. This patent does recognize that all these methods can be singularly useful to accomplish the herein invented secondary tightening of the harness effect so one could mention many of such mechanical techniques and not begin to mention them all. To name a few of the better known mechanical devices which could also be successfully applied to the invented secondary tightening of the harness herein disclosed, one could mention mechanical means like levers or block and tackle or lead screws or ratchet devices and so forth. It should be noted that in any embodiment utilizing a tightening means which doesn't employ air or gas pressure that a back cushion for the horse 21 should be employed. This could be any shape or material but is shown as a circular cushion of foam in this figure.

Figure 5:
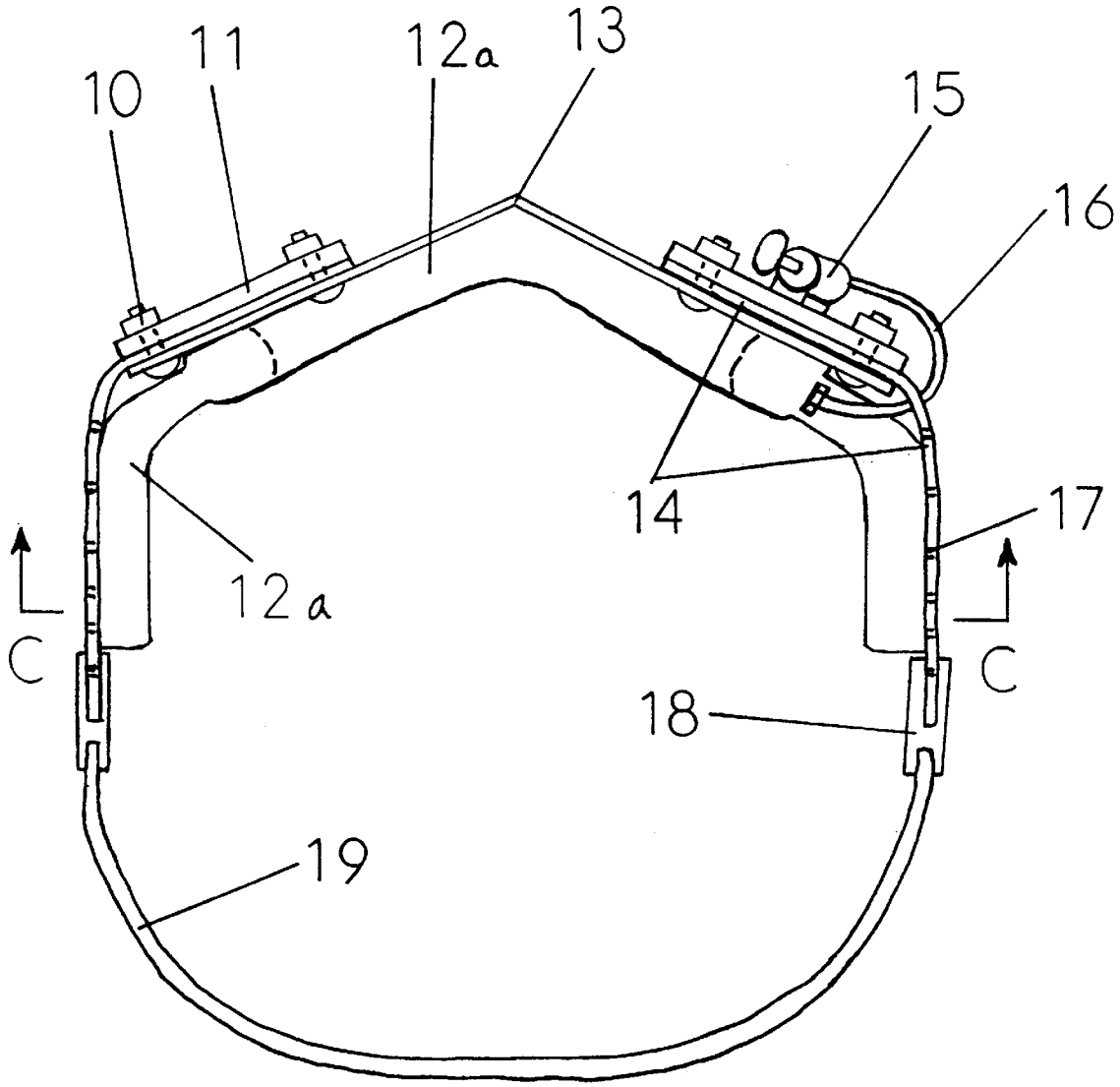
FIG. 5 is an end view of harness with an extended air cushion.

FIG. 5 is a view like FIG. 1 but showing item 12*a* which is an extended air pressure receptacle that goes down along the sides of the horse to give an increased tightening effect when inflated. If so desired it is obvious that the air bag 12*a* could be elongated enough to go the whole way around and underneath the horse's belly without violating the subject matter taught in this patent.

Figure 6:
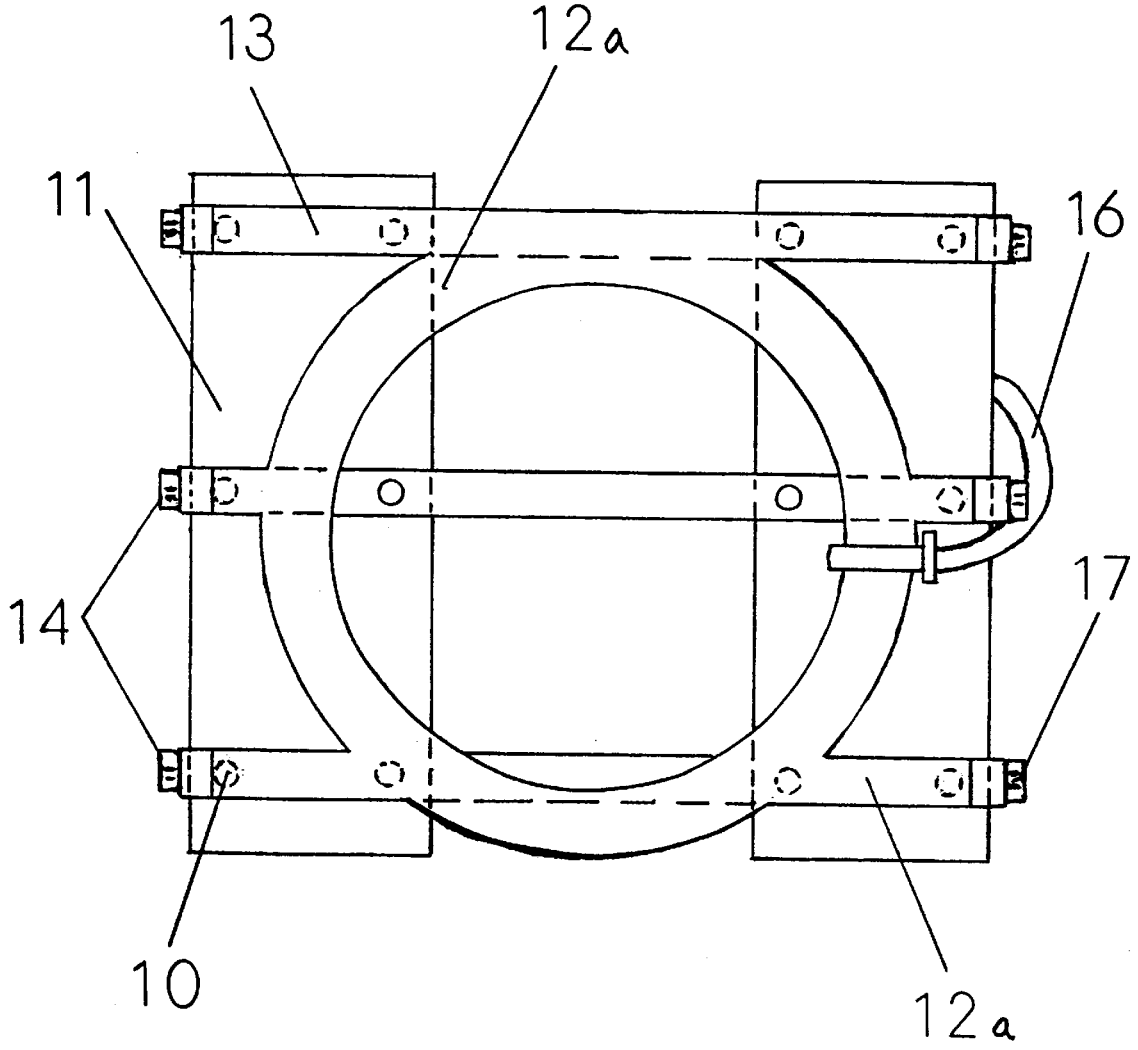
FIG. 6 is a bottom view of the harness shown in FIG. 5.

FIG. 6 is view C—C showing the underside of the assembly shown in FIG. 5 which gives only one example of what shape the extended air bag could acquire. Many shapes are possible and would work properly without violating this patent's teachings.

Figure 7:
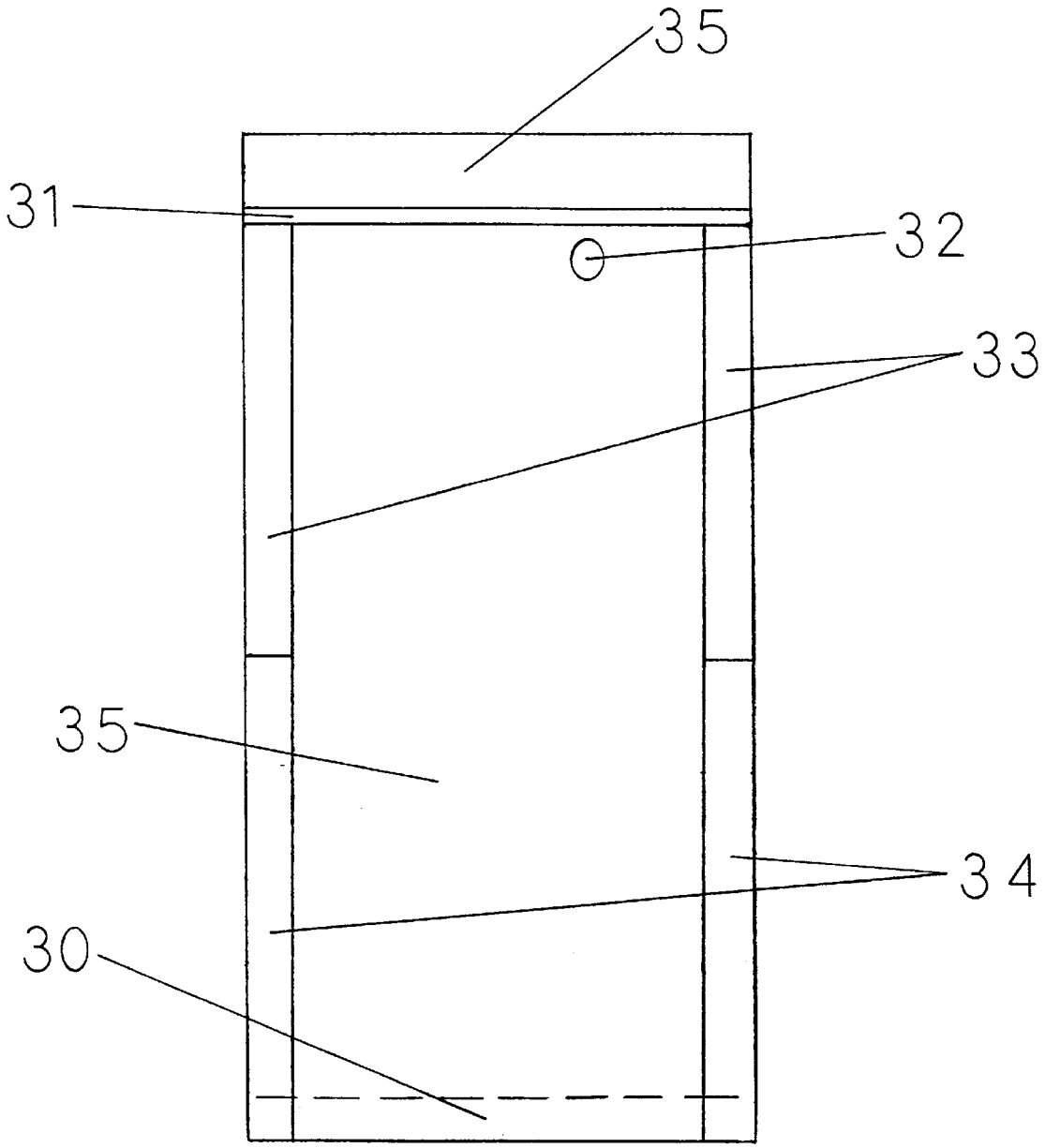
FIG. 7 is an side view of the harness's cover.

FIG. 7 is a side view of one design of a nonessential but useful cover for the assemblies shown in FIGS. 1 through 6. It is made of a heavy fabric or similar material and utilizes hook and loop fastener strips along its inside edges to hold it closed around the top, mechanical parts of these assemblies and in a position which folds it around and over the top and bottom of said assemblies. This cover 35 lays against the horse's back underneath the harness assembly and folds around and up and over the top of the harness assembly. Item 32 is an access hole to allow a pump or winch or lever handle etc. to project through the cover 35 so that a user could access said handle while this cover is in place. This cover 35 would cover only the top assembly of parts of said harness assembly allowing items 14, 18 and 19 to project beyond its edges. It would have its lower border positioned just at the downward curve in straps 14. Items 33 and 31 are hook fastener strips and items 34 and 30 are loop fastener strips which mate with one another to hold the cover closed around the harness assembly when this cover 35 is folded through its center located at the juncture of strips 33 and 34.

Figure 8:
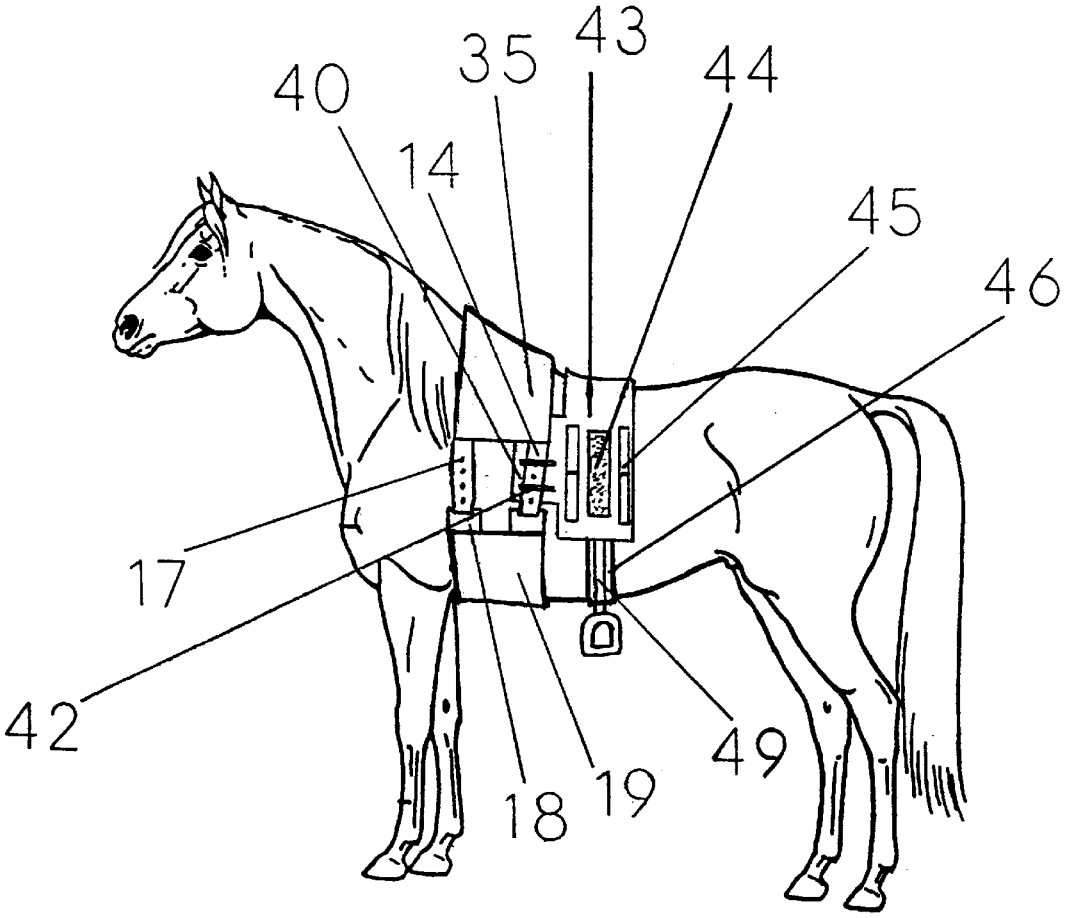
FIG. 8 is a view of a horse wearing the Grab Saddle System.
Figure 10:
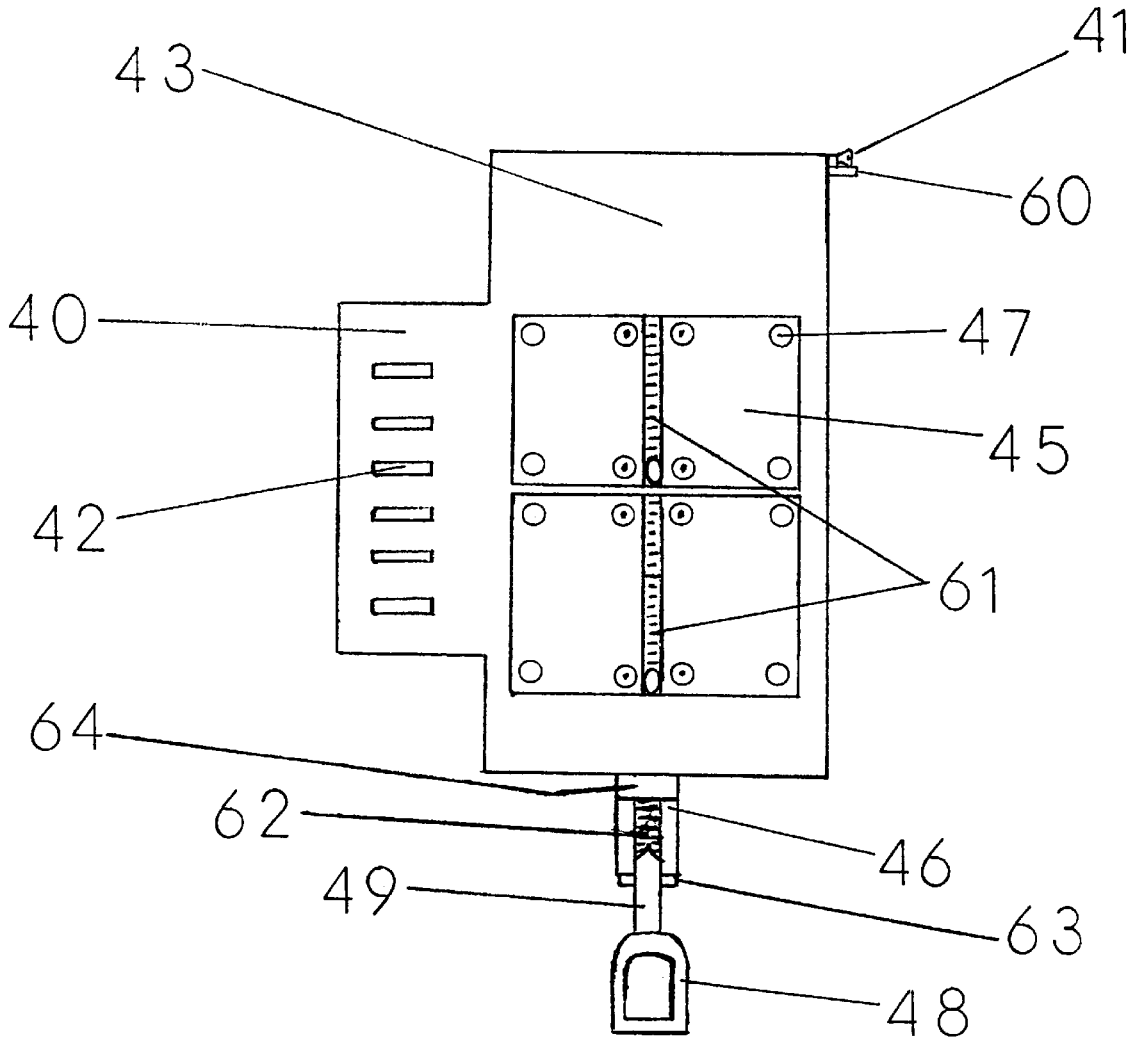
FIG. 10 is a side view of the Grab Saddle.
Figure 11:
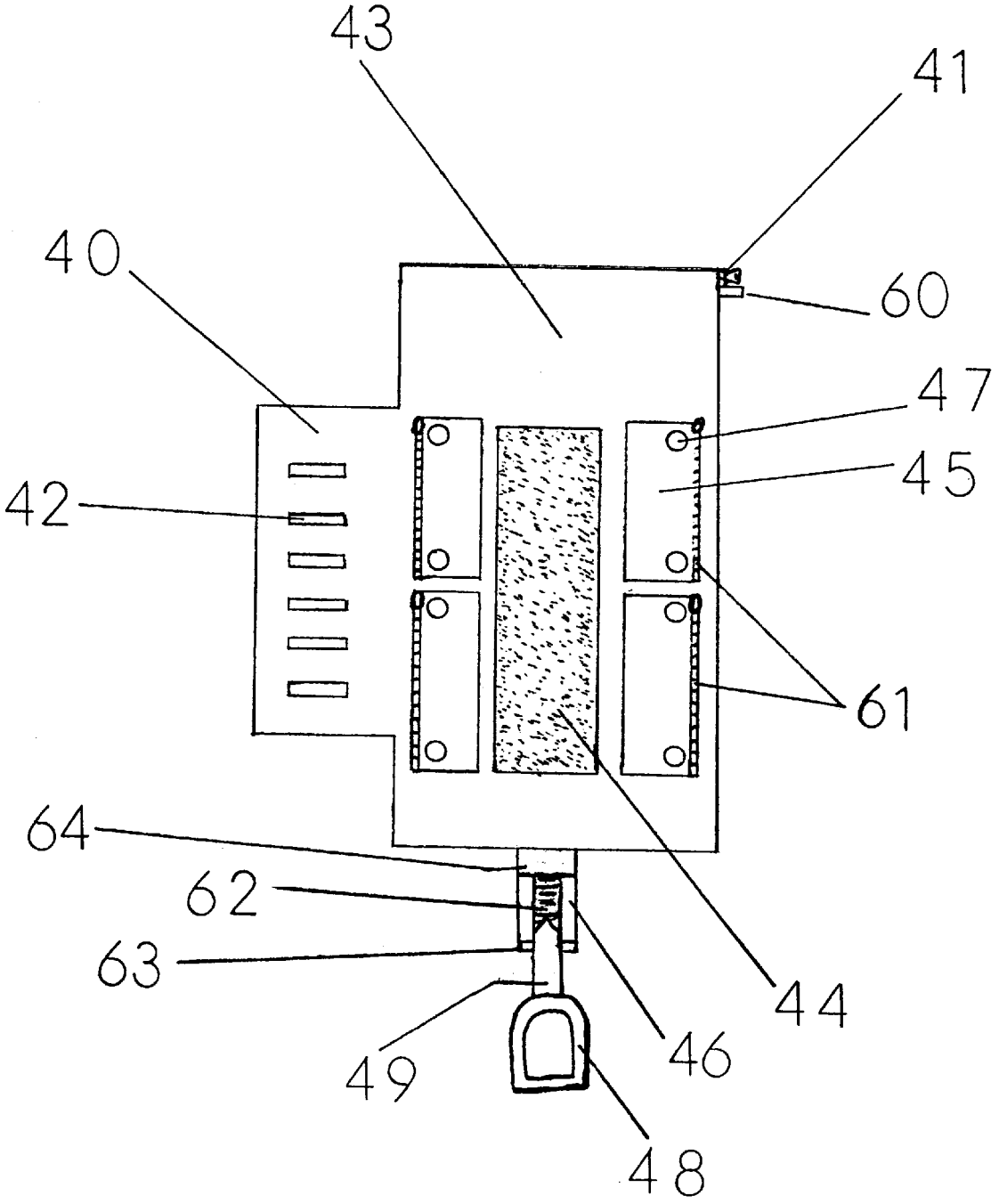
FIG. 11 is the same view as in FIG. 10 with cover flaps open.
Figure 14:
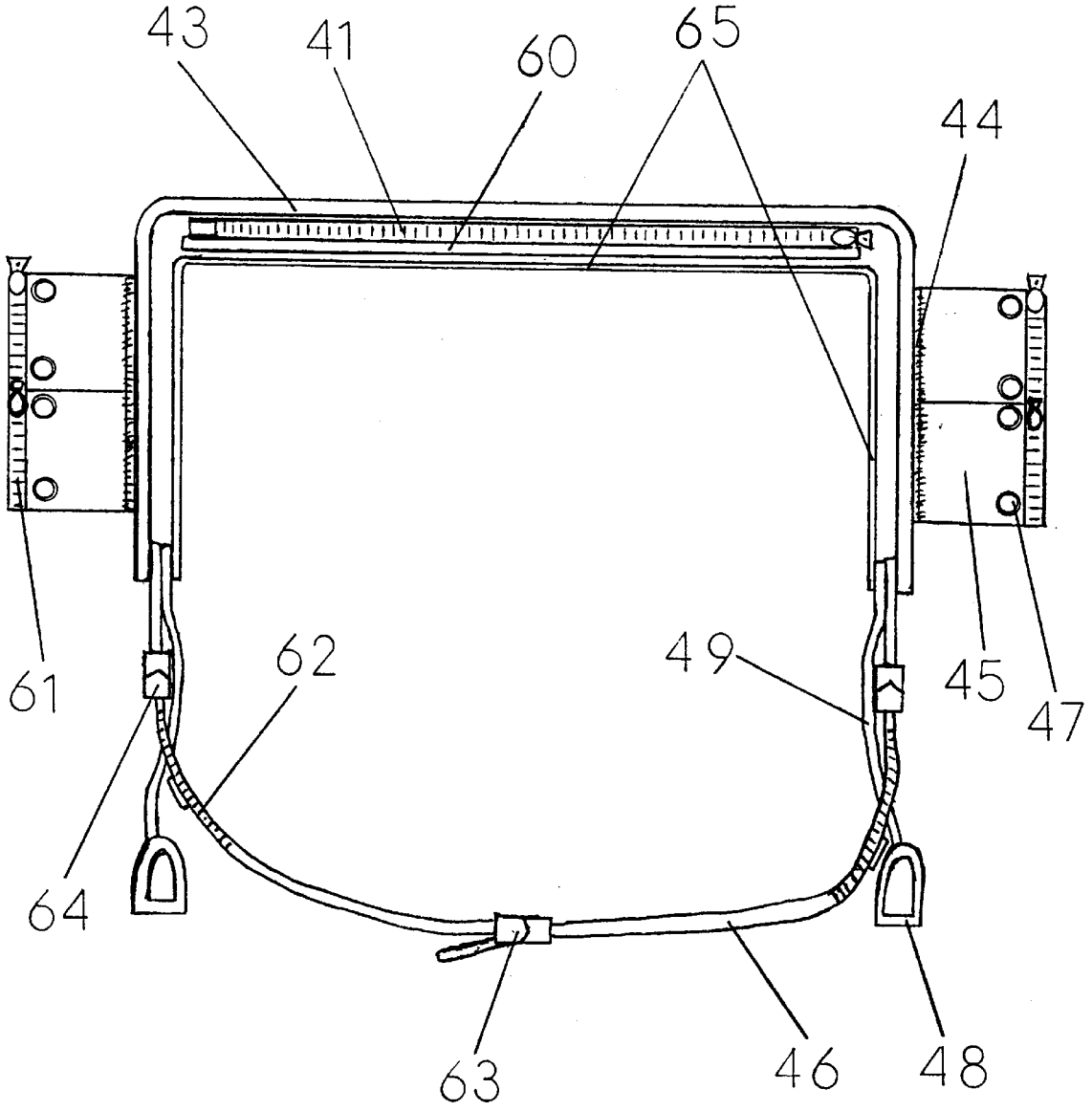
FIG. 14 is an end view of Grab Saddle with cover flaps open.

FIG. 8 is a view of a horse wearing the Grab Saddle System. The Grab Saddle 43 and its harness, embodiments of which are shown in FIGS. 1, 3, 5 and 10, form a system which is a complete seating attachment for a rider on a horse. One embodiment of Grab Saddle is shown in FIGS. 10, 11 and 14. Harness strap 14 fits through Grab Saddle slots 42 in slot flap 40 thus securing Grab Saddle to the straps 14 and locking it in position on the horse. There are no other parts necessary such as saddle blankets or saddle pads etc. since all of the parts which comprise the Grab Saddle system and which contact the horse's skin are made of fabric. The Grab Saddle System gives the rider a much more secure seating on the horse than any other saddle system known. The secondary tightening device described in several of these previous figures may be included as a part of this Grab Saddle System or it can be omitted. It is not essential for the proper operation of this Grab Saddle System. It is, however, an enhancement to the operation of the Grab Saddle System when incorporated into that system. More explanations of the item numbers in FIG. 8 which has not yet been given will be found by referring to FIGS. 10, 11 and 14 where the enlarged detail of Grab Saddle is easier to reference.

Figure 9:
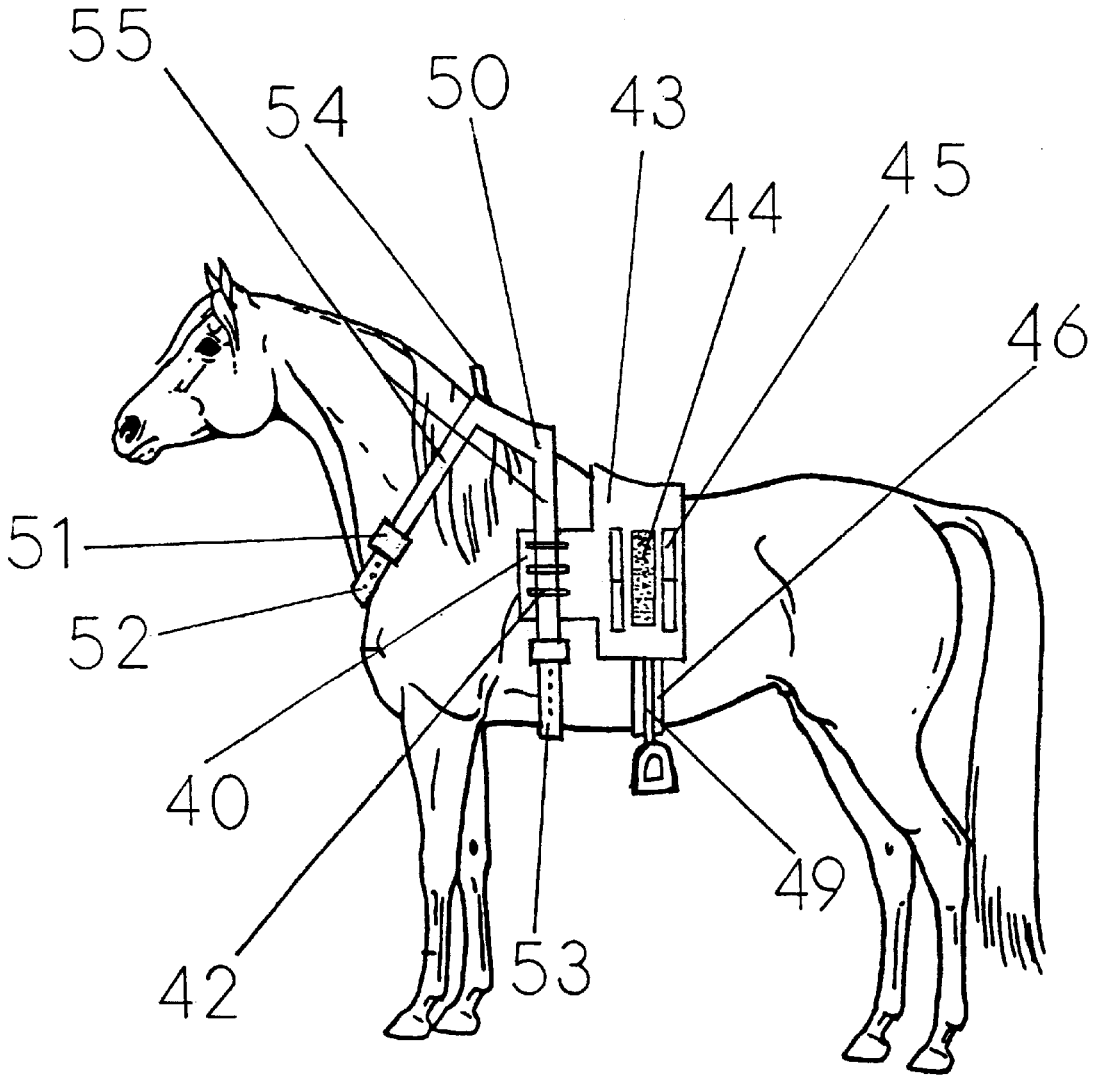
FIG. 9 is a view of a horse with an alternate Grab Saddle System.

FIG. 9 is a view like FIG. 8 but showing another embodiment of the harness for Grab Saddle. Item 50 is a connector between item 55 around the horse's neck and item 55 which is around the horse's chest. Items 50 and 55 can be made from a strong canvas like material such as some of the latest high strength fabrics made from man made fibers or it can be made of a rigid or semi-rigid material such as metal or plastic or fiber glass etc.. The choice depends on how much like a current rigid saddle tree the user wants these parts to be. The more rigid, the more firm the harness will be in maintaining its positioning from side to side on the horse during the rider's mounting or during sharp turning while riding. Item 54 is an air pressure valve fitting which can accept the connection of an air pressure hose from an air pump or other source of pressurized gas to allow inflation and deflation of said items 55 so the invented secondary tightening of the harness function can be accomplished utilizing the expansion of the air chambers found inside items 55. Item 53 is a common girth strap whose connection and also primary length adjustment is made using at least one of the buckles 51 which buckles also permit the same connection and length adjustment for item 52 which is a neck harness strap and is attached to this same harness assembly 55. A single, adjustable connector strap goes between the horses front legs and is connected between and helps to hold straps 52 and 53 in position relative to one another. It is not shown in FIG. 9 but such straps are in common use between horse's front legs and need no further explanation here to be understood by those who posses even a limited amount of horse knowledge. This connector strap between the horse's front legs has its own length adjustment buckle. This connector strap's main function is to keep the neck strap 52 from riding up the front of the horse's neck when in use. These straps can be made from leather or a strong fabric etc. but may also be covered by a soft sleeve of wool for example, to prevent damage to the animal's skin.

FIG. 10 is a side view of one embodiment of Grab Saddle as described in my previous patent U.S. Pat. No. 5,423,164. Item 43 is the saddle proper and also gives indication of what part of the saddle is the portion where the rider actually sits. Item 40 is one of the two front slot flaps whose slots 42 permit passage in and out by the harness straps 14. This secures the Grab Saddle to its harness and therefor to the horse. These items 43 and 40 are the only items that are essential to the proper operation of the grab saddle. All the other items described by this FIG. 10 are non essential attachments which are enhancements to the operation of grab saddle but are not essential to that proper operation. Item 64 is one of two identical buckles which allow the Grab Saddle girth strap 46 to be attached to Grab Saddle proper. This girth strap goes around the horse's belly to provide additional attachment for Grab Saddle to the horse. It can be covered with a wool or some other fabric cushioning sleeve to protect the horse's belly skin. Item 62 is one of two identical zippers which exist on both ends of the Grab Saddle girth strap which provide, when open, an opening for the stirrup to pass through and when zipped up against the stirrup strap 49 each zipper captures its protruding stirrup 48 and holds it perpendicular to the length of the horse. This allows it to be in the proper position for the rider to get their foot into the stirrup without the problem now current in all saddles where the rider must twist the stirrup 90 degrees before the foot can be inserted. Item 63 is the length adjustment and bottom attachment buckle for the Grab Saddle girth strap. It allows for adjustment of said girth strap for the size of the horse's belly so Grab Saddle can fit a wide range of horses. Items 61 are zippers which hold the cover flaps 45 closed in place covering over the hook fastener strips 44 when they are not needed to hold the rider in place in the saddle. Items 47 are the snap fasteners employed on Grab Saddle to hold the cover flaps 45 folded back and away from the hook fastener strips 44 when the rider needs the fastener strips 44 exposed and available to hold the rider in place on the horse. The hook fastener strips 44 are exposed by opening the zippers 61 and folding cover flaps 45 in half back upon themselves and snapping snaps 47 onto each other to keep cover flaps 45 locked in their open position so they don't fall back and cover over the hook strips 44 until the rider is done riding. To dismount, the rider needs only to kick their right leg out and away from the horse to disengage the loop fastener strip on their pants leg or chaps from the hook fastener strip on Grab Saddle. This allows them to dismount normally without any delay in dismounting being caused by the hook and loop fastener strip connections that hold them securely on their mount while riding. After the rider's right leg has been kicked loose, the rider's left leg will come free from its hook fastener strip 44 without any further effort or notice on the rider's part as the dismounting progresses. When needed, because of different types of riding requirements, the top cover flaps may be left closed and the bottom cover flaps left open so that only the rider's calf portions of their legs will be attached to the hook strips 44 while riding. Likewise, if the rider chooses, the bottom cover flaps may be left closed while the top cover flaps are opened. This will insure that only the rider's thigh portions of their legs will be attached to the hook strips 44 while riding. This Grab Saddle feature gives riders using Grab Saddle control over how much and what type of leg attachment to Grab Saddle they want while riding. Item 60 is a flap made of fabric sewed onto Grab Saddle proper which protects the horse's skin on its back from possible abrasion by the seat cushion pocket zipper 41 which is used to open and close the seat cushion pocket where the rider may insert a foam or air cushion that will protect their posterior from hard bouncing while they ride.

FIG. 11 is the same view as FIG. 10 but shows the cover flaps 45 unzipped and folded back and snapped in their retracted position using snaps 47 thus exposing hook fastener strip 44 so it can mate with the loop fastener strip attached to the rider's leg when said loop fastener strip comes in contact with the hook fastener strip as the rider is mounting into the saddle. It is possible to use Grab Saddle successfully with only items 40, 42, 43 and 44 in place on Grab Saddle. Any other items shown on FIGS. 10 and 11 are simply additional items to make Grab Saddle more efficient.

Figure 12:
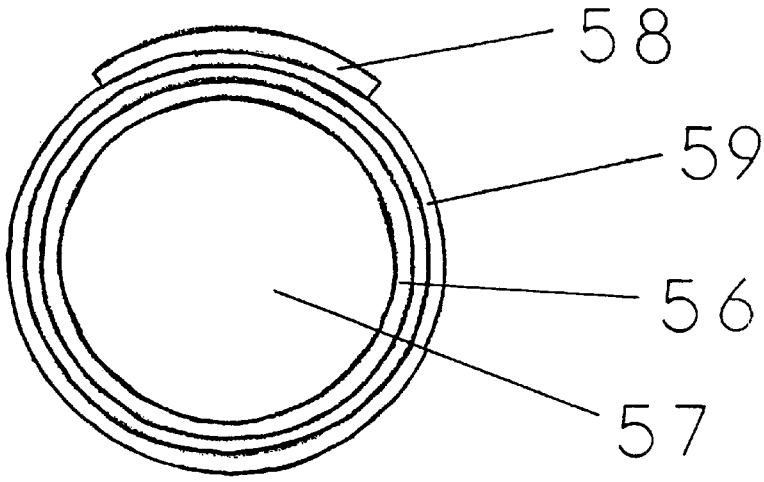
FIG. 12 is a cross sectional view of Item 55*a;*
Figure 13:
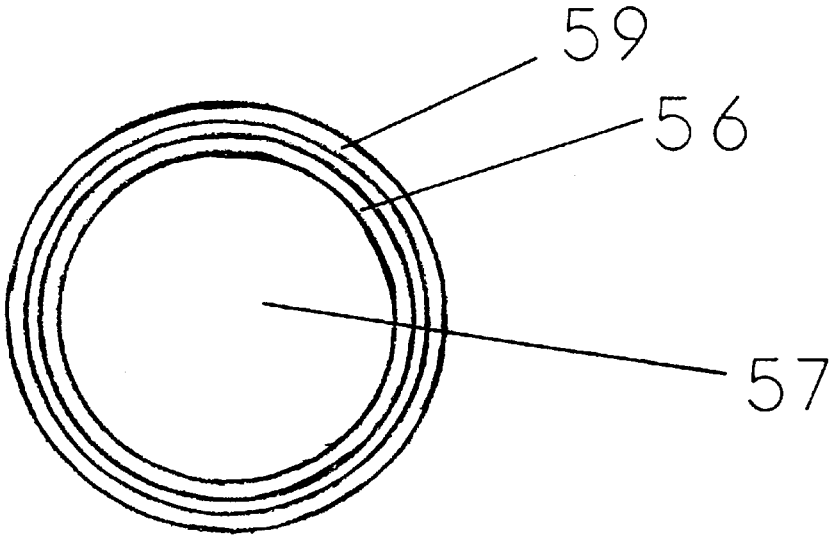
FIG. 13 is a cross sectional view of Item 55.

FIG. 12 is a cross sectional view of item 55*a* which is the same as item 55 as shown in a side view in FIG. 9 except that as item 55*a* it has the addition of a metal or plastic rigid or semi-rigid stay or strap 58 which provides a frame against which the regular item 55 as shown in FIG. 13 can support itself. Item 58 thereby acts to stiffen the whole harness assembly. This adds somewhat to the stability of the harness assembly when attached to the horse and helps prevent slipping sideways of the saddle. Item 55*a* also contains an inflatable air pressure tube 56 which contains air or some other compressed gas 57. This tube 56 is covered by a sleeve 59 made of a canvas like fabric. This inflation of said tube 56 accomplishes the invented secondary tightening of the harness function. This occurs as the gas expands the dimensions of item 55 around the horse after the user or rider has first pulled the girth strap 53 and neck strap 52 and their connector strap as tight as possible by hand.

FIG. 13 is a cross sectional view of the same item 55 shown in the side view in FIG. 9. It is an inflatable air pressure tube 56 which contains air or some other compressed gas 57. This tube 56 is covered by a sleeve 59 made of a canvas like fabric. This inflation of said tube 56 accomplishes the invented secondary tightening of the harness as the gas expands the dimensions of item 55 around the horse after the user or rider has first pulled the girth strap 53 and neck strap 52 and their connector strap as tight as possible by hand thereby accomplishing the primary tightening.

FIG. 14 is an end view of one embodiment of Grab Saddle. All of these items have been explained by number in previous explanations of the figures. In FIG. 14 however, the full length of the seat cushion pocket zipper 41 may be seen with its accompanying fabric flap 60. Also, the insertion of the stirrup straps 49 through the opening in the Grab Saddle girth straps 46 may be seen. The relative position of several other items may also be noticed.

Figure 15:
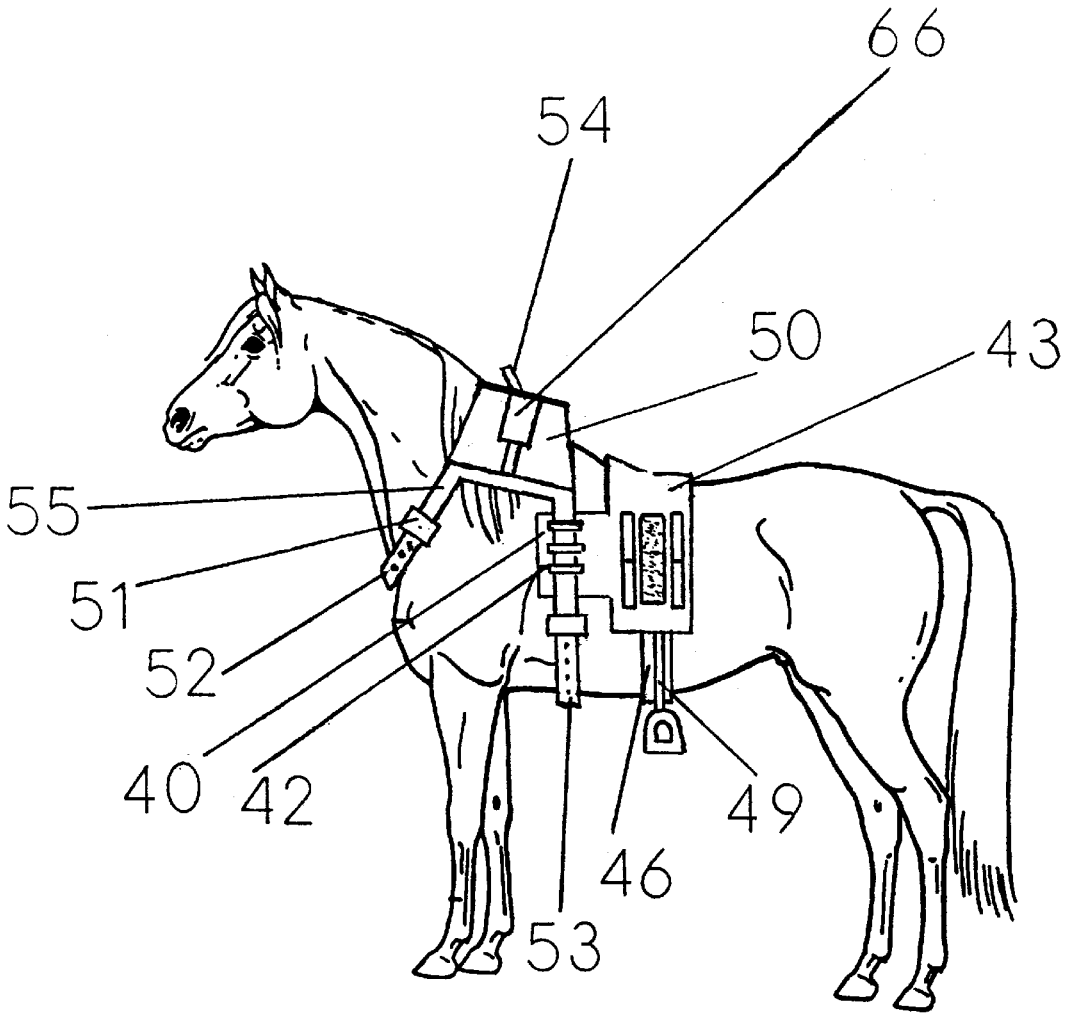
FIG. 15 is a view of a horse with an alternate Grab Saddle System.

FIG. 15 is the same as FIG. 9 but illustrates yet another design approach to effecting the invented secondary tightening of the harness effect by utilizing a compressed gas operated piston device 66 with an internal coil spring return. Such compressed gas piston cylinders are readily available on the market and need no elaboration here as to their construction. They extend their piston rod out of its cylinder when gas pressure or hydraulic pressure is introduced into that cylinder and then their internal coil spring automatically retracts the piston rod back into their cylinder when said pressure is allowed to escape that cylinder. This piston assembly 66 is placed in line with item 55 on both sides of the horse so as to extend when air or some other gas pressure is introduced into its cylinder's interior. This extension of the piston rod then allows the rider or horse handler to hand tighten the neck strap 52 and the girth strap 53 and their connector strap and then buckle them off to hold that preliminary tightened position. After that initial tightening is accomplished as described, the gas pressure or hydraulic pressure inside the cylinder is released to allow the internal coil spring inside the cylinder to pull the piston rod back into the cylinder as far as the harness straps will allow it to go. This arrangement will keep the harness straps around the horse under constant spring tension and thereby keep saddle slippage from occurring as often.

It is obvious that the embodiments of this invention could be successfully effected using many different types of materials other than those described in this patent and even different from those normally used currently by horse saddles for the parts described in these FIGURES. I do not intend to limit these designs to only steel parts or some other metal or wood or plastic parts or leather parts. The steel or wood parts, for example, could be fiberglass or some other plastic or even some other material such as a sweat wicking fabric or graphite fiber filled composite material. The leather parts could instead be made of a high strength fabric or plastic or still some other material.

It is also obvious that there are exhibited on the FIGS. 10 and 11 in the drawings, many mechanical means and items which are not essential to the basic operation of Grab Saddle as a safety device for horse back riding. The four items in FIG. 11 which are essential are items identified as item 40, 42, 43 and 44. All the other items shown in that FIGURE and FIG. 10 are extra to improve the efficiency of Grab Saddle.

It is also obvious that there are many mechanical methods of tightening straps around the body of an animal that have not all been defined exactly in this patent. This patent however encompasses all such means of decreasing the circumference of the girth straps and harnesses with which saddles are held onto horses to achieve the invented secondary tightening of the harness effect.

It is also obvious that other means of enlarging the preferred embodiment's inflatable gas bag which tightens the girth around the horse for its secondary tightening of the harness could be utilized, such as increasing the size of said gas bag hydraulically rather than pneumatically or such as sourceing the compressed gas for pneumatic inflation from a carbon dioxide pressure cylinder rather than pumping the air into the inflatable tube to enlarge it thereby tighten the harness a given amount as my patent teaches.

It is obvious that there are many different mechanical methods to control the up and down inflation and deflation of the inflatable tube or air bag and this patent intends to encompass all such designs.

It is also obvious that the gas bags or inflatable containers for pressurized gas or liquids identified in the drawings shown in this patent could be of any useful material and configuration and possibly extend entirely around the animal rather than just exist under the top portion of the harness assembly as shown in these drawings.

It is also obvious that different strap tightening mechanisms are well known and many different approaches to strap tightening could prove to be equally effective for this grab saddle system. The piston mechanism 66 shown in FIG. 15 used to shorten the length of the girth strap 53 and the neck strap 52 or the winch as shown in FIGS. 3 and 4 which can be used for the same purpose or the air bladder as shown in FIGS. 1 and 2 can all be used to effect this secondary tightening of the saddle straps. So it is obvious that the shortening of straps 52 and 53 which effects their tightening can be accomplished by many different mechanical devices or designs such as those already described earlier in this patent. Some likely mechanical devices that qualify as candidates to provide this secondary shortening of the straps that hold the saddle in place would be lead screws or block and tackles or sprockets and chain or ratchet mechanisms or lever arms, etc..

It is also obvious that the secondary tightening device described in several of these previous figures may be included as a part of this Grab Saddle System or it can be omitted. It is not essential for the proper operation of this Grab Saddle System. It is, however, an enhancement to the operation of the Grab Saddle System when incorporated into that system.

It is also obvious to anyone that rides that the devices described here in this specification and the claims can easily be adapted for use with regular, old fashioned saddles and tack. The concepts this patent covers are mainly the removing of the saddle's structure from under the rider and placing it forward onto the horse's withers as well as the secondary tightening of that structure as well as the safety feature of hook and loop fastener strips holding the rider in place to prevent most accidental dismounts. Of course there are other concepts explained as well as those listed immediately above which are taught for the first time here in this patent, but those I have listed immediately above are the primary concepts taught in this patent.

It is also obvious that the Grab Saddle and Grab Girth combination, once they have been connected together on the horse's back, are not only a great safety device but also a great therapy saddle for healing lame horses to be used when they are exercised by having a rider ride them. It is also obviously a great saddle for helping disabled people to stay on their therapy horse when they ride to improve their health. Grab Saddle, when used together with Grab Girth, completely eliminates the need for a regular saddle to be used although they can be used in conjunction with some designs of regular saddles if the rider desires. It is obvious that common buttons, etc. can be substituted for the snaps and zippers etc. used on Grab Saddle and Grab Girth.

I claim:

1. A saddle assembly for beasts of burden, comprising:

a) a fabric saddle having a seat and two sides and comprising hook fastener strips attached to said sides for engaging loop fastener strips disposed on the legs of a rider on said animal; and b) front flaps having slots therein for inserting and containing girth straps.

2. A saddle assembly for beasts of burden, comprising:

a) a fabric saddle having a seat and two sides and comprising hook fastener strips attached to said sides for engaging loop fastener strips disposed on the legs of a rider on said animal;

b) front flaps having slots therein for inserting and containing girth straps;

c) cover flaps for separating said hook and loop fastener strips;

d) a pocket for containing a seat cushion, said pocket being disposed under said seat;

e) a length-adjustable, detachable girth strap having ends operatively connected, respectively, to each of said saddle sides, said girth strap bridging across the bottom opening of said saddle and containing openings at each of said ends;

f) closure means attached to said girth strap openings for permitting pass through and capture of stirrups and stirrup straps; and g) stirrup straps attached to the lower extremities of said saddle.

3. A saddle assembly which adds any of the singular features c), d), e), f) and g) as detailed in claim 2 to the basic features detailed in claim 1.

4. The saddle assembly as in claim 1 wherein said two sides comprise loop fastener strips attached for engaging hook fastener strips disposed on the legs of said rider on said animal.

5. A harness and strap assembly for tightening around horses or other beasts of burden, comprising:

a) at least one mechanically adjustable harness strap to provide primary tightening which is wrapable around the body of a horse or other beast of burden;

b) a semi-rigid assembled harness unit which fits over the neck and shoulders of the horse or other beast of burden at the location of the fourth through seventh thoracic vertebrae to ensure an anchoring position of said harness over top of the normal shoulder hump of said horse or other beast of burden; and c) structural means for joining said at least one mechanically adjustable harness strap into said semi-rigid assembled harness unit.

6. The harness and strap assembly as in claim 5 wherein said at least one mechanically adjustable harness strap permits secondary adjustment of the tension on said mechanically adjustable harness strap and wherein said secondary tightening means comprises a flexible bladder containing gas.

7. The harness and strap assembly as in claim 6 wherein said means for providing secondary tightening of said at least one mechanically adjustable harness strap adjusts the length of said mechanically adjustable harness strap and wherein said secondary tightening means comprises a winch with winch handle.

8. The harness and strap assembly of claim 7 further comprising an operated piston and piston cylinder operatively connected to said at least one mechanically adjustable harness strap for providing a secondary tightening of said harness.

9. The harness and strap assembly as in claim 6 further comprising a manual air pump for inflating said flexible bladder.

10. The harness and strap assembly as in claim 6 further comprising a compressed gas cylinder with gas release controls for inflating said flexible bladder.

11. The harness and strap assembly as in claim 6 wherein said bladder is elongated to encompass the greater part of the diameter of the chest portion of the animal.

12. The harness and strap assembly as in claim 11 wherein said elongated gas bladder is also extended to encompass the greater part of the diameter of the neck portion of the animal.

13. The harness and strap assembly of claim 12 wherein said elongated gas bladder comprises a semi-rigid stay support extending a substantial portion of the entire length of said elongated gas bladder.

14. The harness and strap assembly of claim 13 further comprising straps that encircle adjacent body parts of said animal, said straps being attachable to said elongated gas bladder and said semi-rigid stay supports.

15. The harness and strap assembly of claim 12 wherein said elongated gas bladder comprises a rigid stay support extending a substantial portion of the entire length of said elongated gas bladder.

16. The harness and strap assembly of claim 15 further comprising straps that encircle adjacent body parts of said animal, said straps being attachable to said elongated gas bladder and said rigid stay supports.

17. The harness and strap assembly of claim 15 further comprising an operated piston and piston cylinder operatively connected to said gas bladder for providing a secondary tightening of said harness.

18. A saddle system which combines said harness and strap assembly of claim 5 with said saddle assembly of claim 1, said harness and strap assembly and said saddle assembly being linked together by the juncture of said girth straps of said harness and strap assembly and said front, slotted flaps of said saddle assembly and including other auxiliary attachment devices.

19. A saddle system as in claim 18 further comprising a secondary tightening means as in claims 6 or 7.

* * * * *